United States Patent [19]

Sears

[11] Patent Number: 4,846,157

[45] Date of Patent: Jul. 11, 1989

[54] DEVICE FOR AIDING ABDOMINAL MUSCLE CONTROL

[76] Inventor: M. Hayden Sears, 4215 Kentuck Way, North Bend, Oreg. 97459

[21] Appl. No.: 227,075

[22] Filed: Aug. 1, 1988

[51] Int. Cl.[4] ..... G08B 1/08

[52] U.S. Cl. ..... 178/36; 340/573

[58] Field of Search ..... 128/886, 883, 36; 340/573

[56] References Cited

U.S. PATENT DOCUMENTS

| | | | |
|---|---|---|---|
| 396,212 | 1/1889 | Long | 128/886 |
| 723,259 | 3/1903 | Fraser | 128/886 |
| 1,243,629 | 10/1917 | Roddy | 128/883 |
| 1,266,393 | 5/1918 | Bowen | 128/886 |
| 3,670,320 | 6/1972 | Palmer | 340/573 |
| 3,696,357 | 10/1972 | Filgore | 128/886 |
| 4,007,733 | 2/1977 | Celeste et al. | 340/573 |
| 4,157,540 | 6/1979 | Oros | 340/573 |
| 4,191,949 | 3/1980 | Myers | 340/573 |
| 4,300,129 | 11/1981 | Cataldo | 340/573 |
| 4,343,303 | 8/1982 | Williams | 128/36 |
| 4,732,140 | 3/1988 | Stoffregen | 128/36 |
| 4,764,111 | 8/1988 | Knierim | 340/573 |

FOREIGN PATENT DOCUMENTS

| | | | |
|---|---|---|---|
| 2539296 | 7/1984 | France | 340/573 |
| 2539983 | 8/1984 | France | 340/573 |

*Primary Examiner*—Edgar S. Burr
*Assistant Examiner*—Tonya Lamb
*Attorney, Agent, or Firm*—James D. Givnan, Jr.

[57] ABSTRACT

A band for placement about the human anatomy with switch components on the band and displaceable from one another, upon enlargement of the band, to establish an electrical circuit to a signalling device. An elastic member retracts the band in the absence of anatomical pressure to open the circuit and terminate operation of the signalling device. The signalling device is disclosed as being of the vibratory type.

4 Claims, 1 Drawing Sheet

DEVICE FOR AIDING ABDOMINAL MUSCLE CONTROL

BACKGROUND AND SUMMARY OF THE PRESENT INVENTION

The present invention is embodied in an aid which serves to train certain muscle groups of the human anatomy.

The personal appearance of certain individuals may be enhanced by holding the stomach in which, at least initially, requires conscious effort until such muscle control becomes automatic.

The present device, in one form, includes a band for placement about the lower torso with a segment of the band passing over the belly. Switch components on the band are arranged to establish an electrical circuit upon relative movement between certain of the components, to signal the wearer that muscle relaxation has occurred to the extent the belly is at least somewhat distended. An elastic portion of the band permits movement between switch components to establish the circuit to a signal generator to notify the user of the extent of muscle relaxation followed by remedial muscle control. The signal to the user has been found advantageously embodied in a vibratory mechanism to unobtrusively notify the wearer while concealing such notice to others.

Important objectives include the provision of a muscle training aid which is worn in a concealed manner which signals the wearer when a certain muscle or set of voluntary muscles have relaxed or involuntary muscles have tensed; the provision of a muscle training aid for wear in an inconspicuous manner about the abdomen; the provision of a muscle training aid which may be personally fitted to the wearer and accommodates an infinite number of waist sizes.

DETAILED DESCRIPTION OF THE PREFERRED EMBODIMENTS

Figure 1:
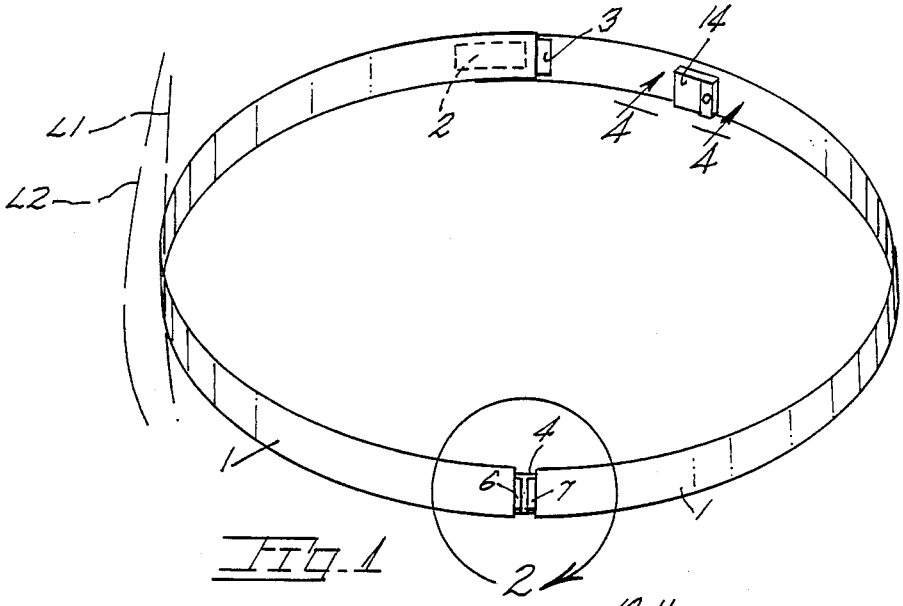
FIG. 1 is a perspective view of the aid.
Figure 2:
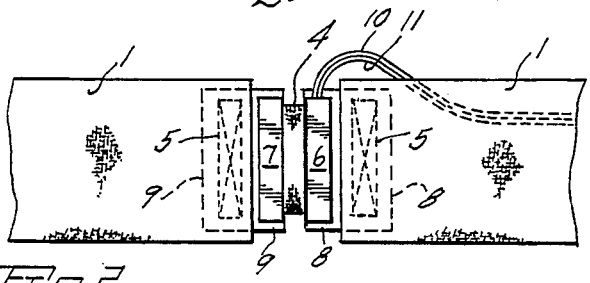
FIG. 2 is an enlarged view of that portion of FIG. 1 encircled at 2.
Figure 3:
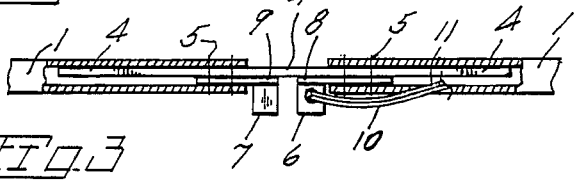
FIG. 3 is a plan view of FIG. 2.
Figure 4:
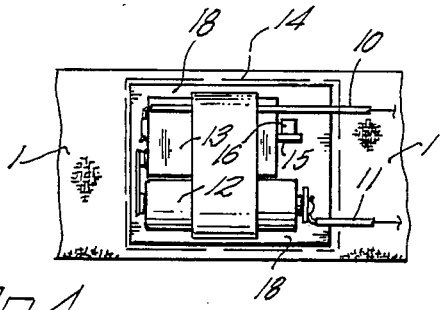
FIG. 4 is an enlarged elevational view of that portion of the aid taken along line 4—4 of FIG. 1.

With continuing attention to the drawings wherein applied reference numerals indicate parts similarly hereinafter identified, the reference numeral 1 indicates a flexible, inelastic band of the present device.

In place on the band are adjustable closure means at 2 and 3 which, as shown, may be strips of hook and loop material of the type sold under the registered trademark Velcro. Various other closure means may be utilized such as hooks, buckles, snaps, etc.

An elastic portion 4 of the band is secured to the band as by stitching at 5 in band end portions. For appearance sake, the elastic member may, for the most part, be concealed within the band proper.

On the band are carried switch means mounted in a manner that upon tensioning of the band a circuit will be established through the switch means. One suitable switch means includes a normally open, magnetic switch 6 responsive to the magnetic field of a permanent magnet 7. Switch 6 and magnet 7 are conveniently mounted on supports at 8 and 9 which may be conveniently secured to the band as by the stitching at 5. Conductors at 10 and 11 put switch 6 in circuit with a battery 12 and a signal generator 13, the latter may be in the form of a miniature electric motor having an output shaft 15 weighted at 16 in an unbalanced manner to impart vibrator motion to the motor. For convenience sake, the battery 12 and signal generator 13 may be combined for storage in a pocket 14 on the inner surface of the band. The battery and motor may be conveniently mounted on a base at 18.

In use, the band is applied about the lower torso whereat a portion of the band extends over the abdomen indicated by phantom lines L1 and L2. The band is sized by the user by joining of the closure material 2 and 3 with the abdominal muscles retracted to the desired state represented by line L1. Thereafter, any relaxing of the muscles will cause elastic member 4 to stretch with displacement of the switch components resulting in the establishment of a signal generator circuit until such time as the switch components are returned to the close proximity of one another by contraction of elastic portion 4 of the band with opening of switch 6. The signal generator, in addition to providing a silent signal, provides a somewhat unpleasant sensory effect to promote the desired response. It is understood that in some uses an audible signal generator may be preferred in place of motor above described. The device may also be used on a much smaller scale to signal involuntary muscle activity to aid in overcoming impotency.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A muscle training device for use on a portion of a persons anatomy, said device comprising, a band for application about a portion of the body and including closure means, said band having two end portions remote from said closure means and an elastic portion joining said two end portions to permit expansion and contraction of the band, a signal generator on said band, magnetic switch means on said band proximate said elastic portion, said switch means including a permanent magnet and a switch and being mounted on said band such that the distance between said permanent magnet and said switch varies with expansion and contraction of said elastic portion, said switch being actuated responsive to expansion and contraction of said elastic portion caused by changes in a person's anatomy, and a power source on said band in circuit with said switch means and said signal generator.

2. The device claimed in claim 1 wherein said permanent magnet closes said switch means when said magnet is displaced away from said switch.

3. The device claimed in claim 1 wherein said signal generator provides a non-audible signal.

4. The device claimed in claim 4 wherein said signal generator is a vibratory motor.

* * * * *